United States Patent [19]

Brum et al.

[11] Patent Number: 5,000,324

[45] Date of Patent: Mar. 19, 1991

[54] EJECTOR NOZZLE WITH PRESSURE DIFFERENTIAL

[75] Inventors: Jerry W. Brum; James E. Crismon, both of Modesto, Calif.

[73] Assignee: ESM International, Inc., Houston, Tex.

[21] Appl. No.: 491,216

[22] Filed: Mar. 9, 1990

[51] Int. Cl.[5] ..... B07C 5/00

[52] U.S. Cl. ..... 209/580; 209/581; 209/638; 209/644

[58] Field of Search ..... 209/580, 581, 639, 644

[56] References Cited

U.S. PATENT DOCUMENTS

| | | | |
|---|---|---|---|
| 4,371,081 | 2/1983 | Satake | 209/580 |
| 4,426,005 | 1/1984 | Satake | 209/581 |
| 4,624,368 | 11/1986 | Satake | 209/581 |
| 4,699,274 | 10/1987 | Saika | 209/580 |

*Primary Examiner*—Robert R. Song
*Attorney, Agent, or Firm*—Vaden, Eickenroht, Thompson & Boulware

[57] ABSTRACT

A sorting machine for separating substandard items from a continuous flow of fungible items is disclosed wherein the ejector means for removing the detected substandard items includes an air blast nozzle having a built-in end means for creating a pressure differential in the blast to keep particle dust from rising and quickly causing the optical window in front of the detector sensor or sensors to coat and become opaque. The pressure means is preferably a tab or other surface at a right angle to the nozzle or parallel to the product flow, its direction being on the opposite side of the nozzle from the window. By minimizing dust build-up on the window, down time of the sorting machine for window cleaning is minimized.

6 Claims, 4 Drawing Sheets

EJECTOR NOZZLE WITH PRESSURE DIFFERENTIAL

BACKGROUND OF THE INVENTION

1. Field of the Invention

This invention pertains to sorting machines that separate substandard fungible items from standard items, the items flowing through the machine in large volumes at high rates of speed.

2. Description of the Prior Art

A typical sorting machine of the type envisioned for application of the present invention is a high speed sorting machine typically used for sorting fungible products in the food industry or otherwise. For example, individual rice grains are caused to flow by gravity feed down a steep channel to be sorted in such a machine to separate "substandard" grains from standard grains. The term "substandard" can apply to a dark grain that has no useful purpose, but the term can also apply to a grain of different length or other quality that is perfectly acceptable in the abstract, but is not within the standard limits of quality established for acceptable standard products for a particular sorting.

Although products of the type just described can theoretically be sorted by weight, mechanical measurement size or the like, perhaps the most commonly employed sorting mechanism used in today's machines employ optical sensors. Such sensors include one or more photodetectors, such as photodiodes, that are sensitive not only to black, white and shades of gray differences, but also to subtle variations in color hues. Also, such sensors, including the entire sensor combination of parts, are also capable of discriminating against different sizes of products. All of the machines of the general class fitting the above description have in common a protective, light admitting window for the sensor or sensors to protect these sensors from contamination. In some cases, the "window" may only be the sensor element covering, but in many cases it is the common housing enclosing a plurality of sensors that are spaced about an opening through which is directed the flow of product to be sorted.

Such machines also include an ejector mechanism located downstream from the sensor or sensors and actuated by an electrical signal originating from sensor detection. When a substandard product is detected, an electrical actuating signal is produced and the ejector is actuated just as the substandard product and the mechanism are in alignment. Therefore, there is a delay between detection and ejection, but it is ever so slight because the further the ejector is from the detector, the more the substandard product can "escape" by being diverted or hit by other products in the product flow or even by velocity variations caused by friction in the channel depending on the duration of contact with the flow channel or slide as the products tumble along. Therefore, the ejector is normally located as close as possible to the sensor or sensors, ideally being just downstream therefrom and closely adjacent thereto.

The ejector mechanism can be mechanical, but for small fungible products it is almost universally a compressed air ejector. That is, when the substandard product arrives opposite the ejector, the ejector emits a sharp expulsion or jet blast of air that kicks the substandard product from the stream. Typically, the ejector includes an elongated nozzle that has a very narrow opening, at least in the dimension parallel to product flow. The opening is typically slotted or elongated, however, transverse to the flow direction.

Each time the ejector expels a jet or blast of air, not only is the substandard product ejected from the main product stream, the surface of that product and other products that are also contacted by the blast are "dusted". That is, minute loose surface flakes are blown off or apart from the products themselves, these loose surface flakes settling wherever they are blown. These flakes are sometimes referred to collectively as "dust". Most of these dust flakes or particles are harmlessly blown out of the main product flow with the ejected product, but many of these flakes are scattered in various other directions. The ones that cause the most mischief are the ones that settle on the window or windows of the optical sensors, previously described. This is because over a period of time there is a build up of these dust flakes that cause the window or windows to become more and more opaque to the passage of light, which interferes with the sensitivity of discrimination detection necessary for proper sorting operation. When there is excessive build-up, the machine has to be cut off and the window or windows cleaned before the machine is ready to properly operate again. Obviously, it is desirable to minimize the amount of this down time.

Therefore, it is a feature of the present invention to provide an improved sorting machine including air ejection separation of substandard products from a flow of fungible products wherein the ejection mechanism does not rapidly coat the window of a nearby optical sensor with product dust.

It is another feature of the present invention to provide an improved air ejector for separating substandard products from a flow of fungible products passing through a sorting machine, the improved air ejector developing a pressure differential in the air blast therefrom to minimize the number of dust particles that disperse to accumulate on a nearby sensor window.

SUMMARY OF THE INVENTION

In accordance with the present invention, sorting machine includes at least one channel for the flow or passage of fungible products past an optical sensor that produces an actuation signal each time a substandard product is sensed in the stream or flow. The optical sensor is protected by a light transmission window against contamination. Nearby to the window is an ejector for expelling a jet or blast of air at the product flow in response to an actuation signal. The blast not only expels the unwanted substandard product from the stream, it creates spurious dust. A pressure differential mechanism, preferably in the form of a dependent tab or other surface at or near a right angle to the direction of the air blast and on the side of the output nozzle of the ejector away from the window, is included to minimize the amount of upwardly blown dust particles, the path or projection of such particles being downwardly and away from the sensor window. Thus, the amount of build-up of dust on the window is slow compared with an identical ejector not having the pressure differential addition. Such slow build-up reduces the number of machine shut downs for cleaning the sensor window over a period of time.

BRIEF DESCRIPTION OF THE DRAWINGS

So that the manner in which the above recited features, advantages and objects of the invention, as well as others which will become apparent, are obtained and can be understood in detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

In the drawings

DESCRIPTION OF THE PREFERRED EMBODIMENT

Figure 2:
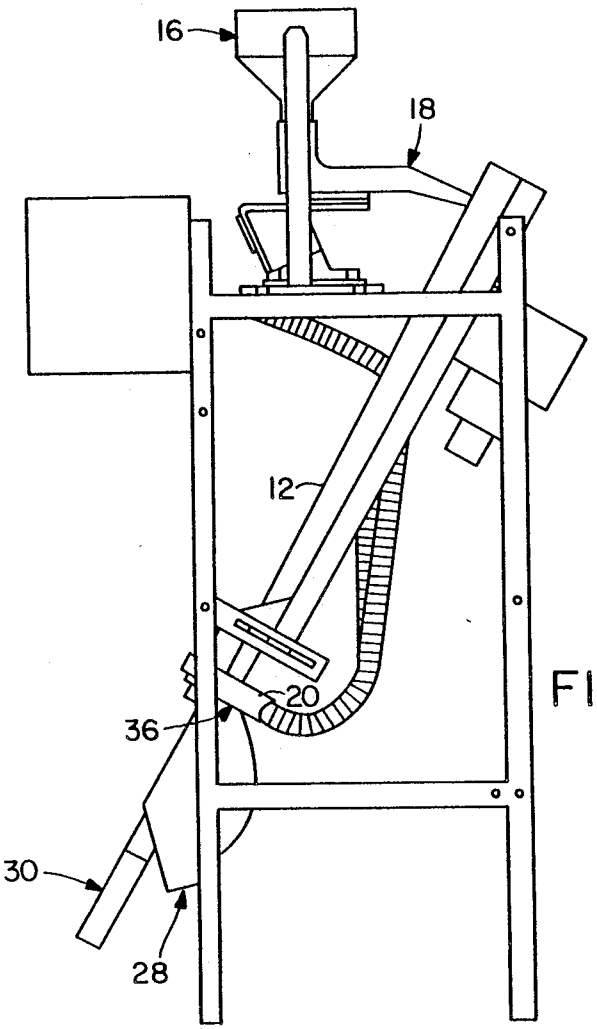
FIG. 2 is a side view of the machine shown in FIG. 1.
Figure 1:
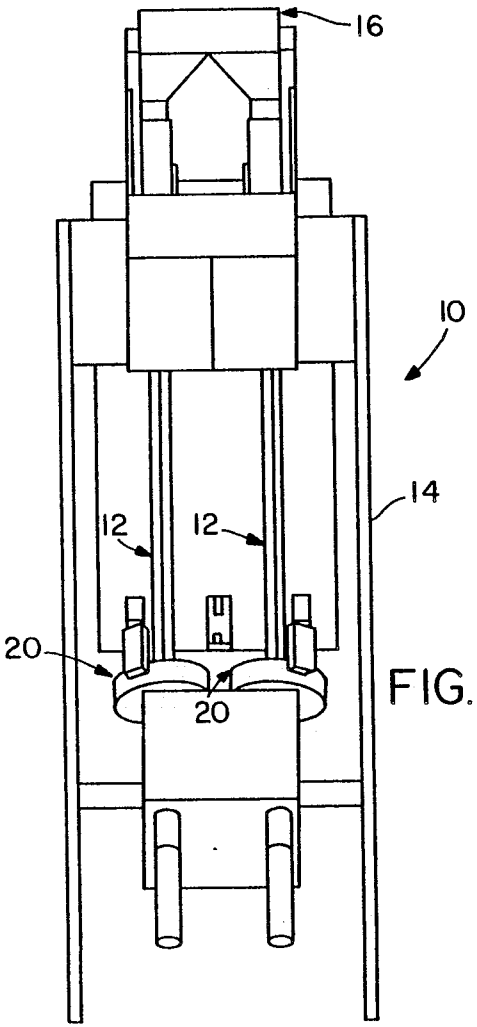
FIG. 1 is front view of a dual channel sorting machine for separating nonstandard products from a flow of fungible products in accordance with a preferred embodiment of the present invention.

Now referring to the drawings and first to FIGS. 1 and 2, a dual-channel, high speed sorter for separating nonstandard fungible products from a passing stream or flow of such products is shown. Generally, machine 10 includes two channels or slides 12 at a steep angle, usually over 45° and preferably nearly vertical on the order of 80°. The channels are held in position by a framework 14 and are gravity fed the product to be sorted at the top by a hopper 16 attached to the same framework. The product feeds from hopper 16 through respective chutes 18 to channels 12. The product to be separated or sorted are small fungible products, such as rice grains. The feed from the hopper via the chutes and down the channels or slides is all by gravity action. The flow of the product is only slowed from free fall by the friction caused by the bends and the surfaces of the path. The product does move, however, quite fast and in large quantity, as is well-known in the art. Although two channels are shown, machines having only a single channel and machines with many more than two channels are common. For purposes of the invention, however, operation of a single channel only needs to be considered.

Figure 3:
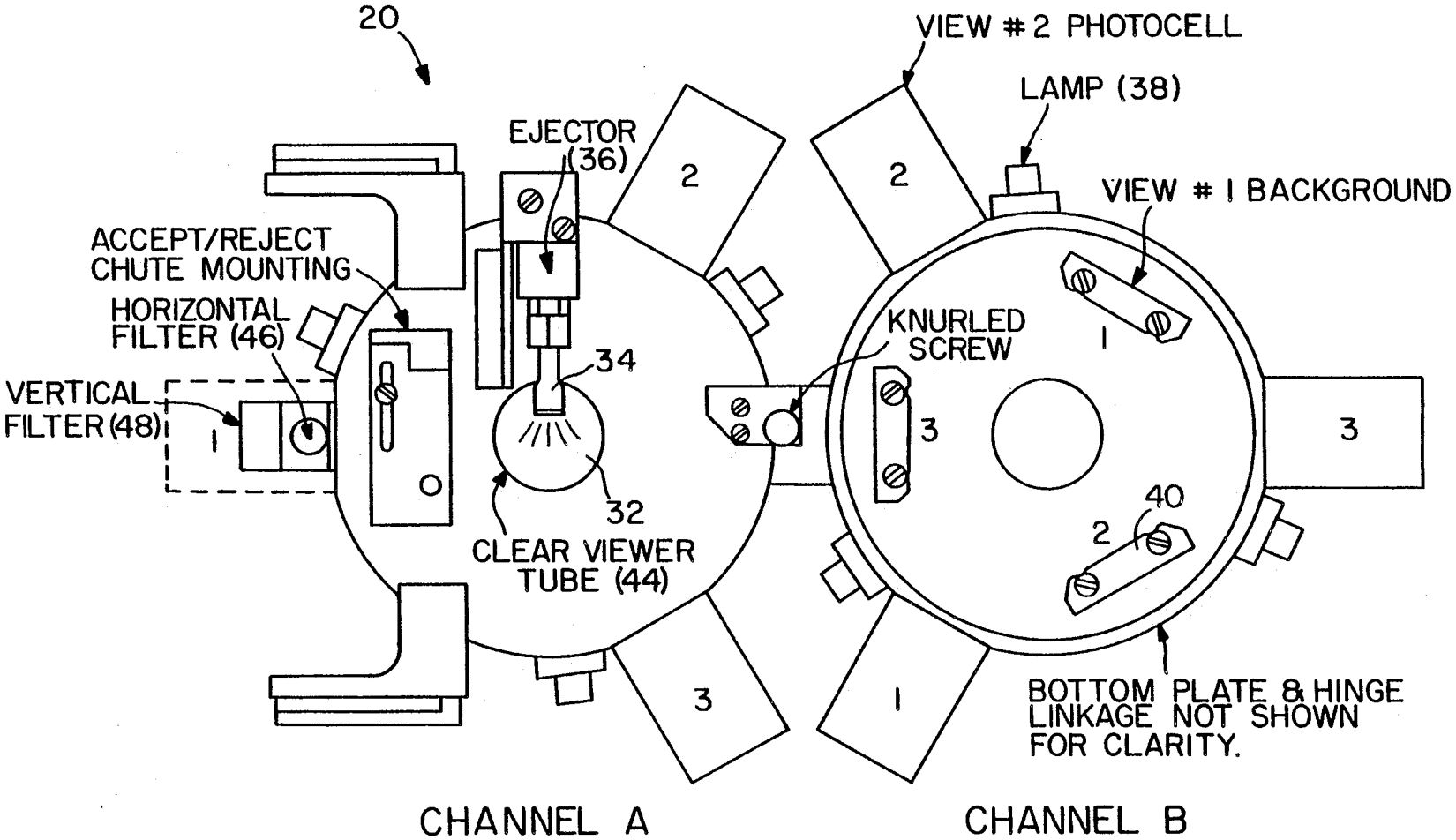
FIG. 3 is a bottom view of the optical sensor arrangement of the machine shown in FIG. 1.

An optical viewer or sensor 20, described more fully with respect to FIG. 3, is located toward the bottom of the machine such that the flow of product passes through the sensor at which time any nonstandard or substandard products are sensed or detected. Typically, substandard rice grains that are detectable are those grains that are darker than a predetermined quality degree of lightness. When such a substandard product is sensed, an electrical signal is produced for ejection actuation purposes.

An ejector 36 located underneath and adjacent optical sensor 20 is actuated by the actuation electrical signal to produce an air blast to remove the unwanted substandard product from the flow of products in the channel. The description of the ejector mechanism is more fully disclosed with respect to FIGS. 4 and 5. When the actuation signal occurs, a solenoid valve (FIG. 4) is operated to release or emit an air blast at the product stream to timely remove the substandard grain. The delay in actuation is very short following sensing and is timed to produce the desired expelling of the detected grain in a manner well-known in the art. The grains thus removed in this process fall down into reject accumulator 28 for subsequent disposal. The grains not removed continue down channel extension 30 to be gathered or packaged as quality products passing the preset standards and avoiding removal. The control of the flow, the sensitivity of the sensors and the like are all controlled by preset controls, as is well-known in the art.

Now referring to FIG. 3, the viewing or optical sensor and related assemblies for the two channels of the machine are illustrated. The bottom of the first channel or Channel A is shown, whereas the bottom plate and below is not shown for the second channel or Channel B. Operationally, however, the two channels are the same.

A sensor 20 generally is a ring-like structure with a center opening 32, the flow of the products to be separated as discussed above passing through that part of the opening close to, but just apart from, nozzle 34 of ejector 36.

The optical or viewing mechanism is well-known, but generally includes three evenly peripherally spaced sensor combination. Referring to the Channel B sensor, it will be seen that a lamp 38 projects its beam against a background plate 40 to be detected by a photocell at each of three peripheral orientations. The housing for the parts is generally a clear viewer tube 44 since it is important that light emission and reception be unimpeded. The component of the system for covering the parts of the optical sensor or sensors is re erred to as a "window", although there may be several separated parts each individually covered.

If the discrimination is also to be made with respect to color or size, appropriate filters 46 and 48 can be included in with the photocells. Further, specific bands of radiation, not necessarily within the visual spectrum, can be employed. Thus, the lamp produces whatever radiation is desirably employed. In any event, it will be evident that the viewing window allows proper operation to occur when it is clean, but operation deteriorates when it becomes opaque to light or other radiation emissions.

Figure 5:
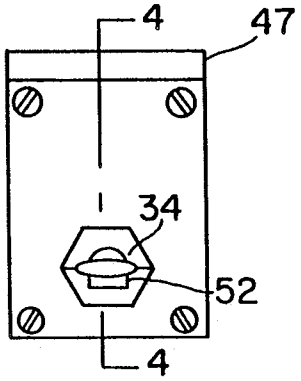
FIG. 5 is an end view of the ejector assembly shown in FIG. 4.
Figure 4:
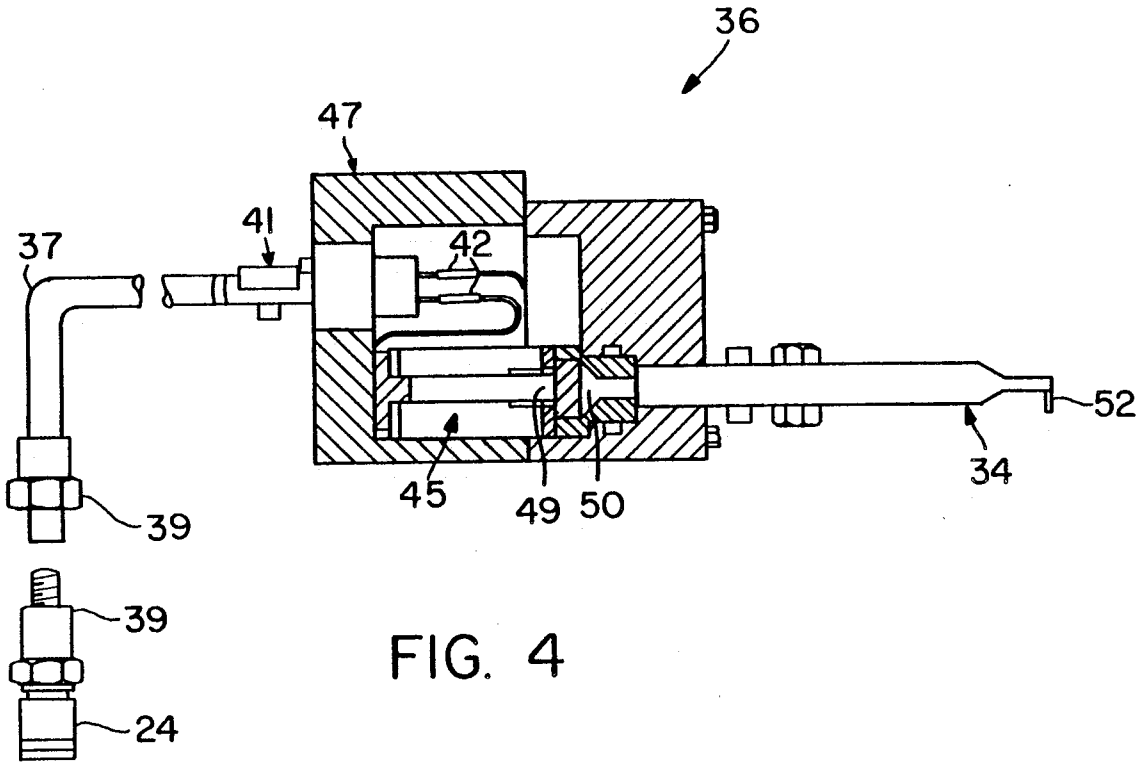
FIG. 4 is a cross sectional side view of an ejector assembly in accordance with a preferred embodiment of the present invention.

Now referring to FIGS. 4 and 5, the ejector apparatus is shown. Ejector 36 generally includes both an air line 37 and various connecting parts 39 and electrical connectors 41 and 42 for the application of the actuation signal to initiate the air blast for the expelling of substandard products. An internal chamber 45 of ejector housing 47 receives the high pressure air via air hose 24. The air applied to the air hose is normally the high pressure shop supply of air that is generally available in a plant location. If none is available, a high pressure air compressor (not shown) may be employed. When the actuation signal is applied, solenoid valve 49 is unseated from valve seat 50 and a jet or blast of air is expelled from nozzle 34. The pattern for that air blast is important to the present invention and is explained more fully with connection to FIGS. 6 and 7. However, it will be seen from FIGS. 4 and 5 that the tip of nozzle 34 ends in a small opening. The dimension of that opening is quite small in a direction parallel with the flow of the product in the channel and is somewhat elongated transverse to that direction (FIG. 5). This allows the blast to expel the detected substandard grain wherever it appears in the flow stream, not just directly in front of the nozzle. Referring to FIG. 3, the blast is fan-shaped as it would be viewed from the bottom.

A depending tab 52 at the tip of the nozzle creates a desirable pressure differential, the top side of the air blast being at a higher pressure than the lower side, so that the jet or blast mainly goes straight out, but with more spurious spewing on the bottom than on the top. That is, in FIG. 6, main air blast 54 is seen to be virtually horizontal, with spurious dust particles 56 below the main air blast being about equal in number to spurious particles 58 above the main air blast.

Figure 6:
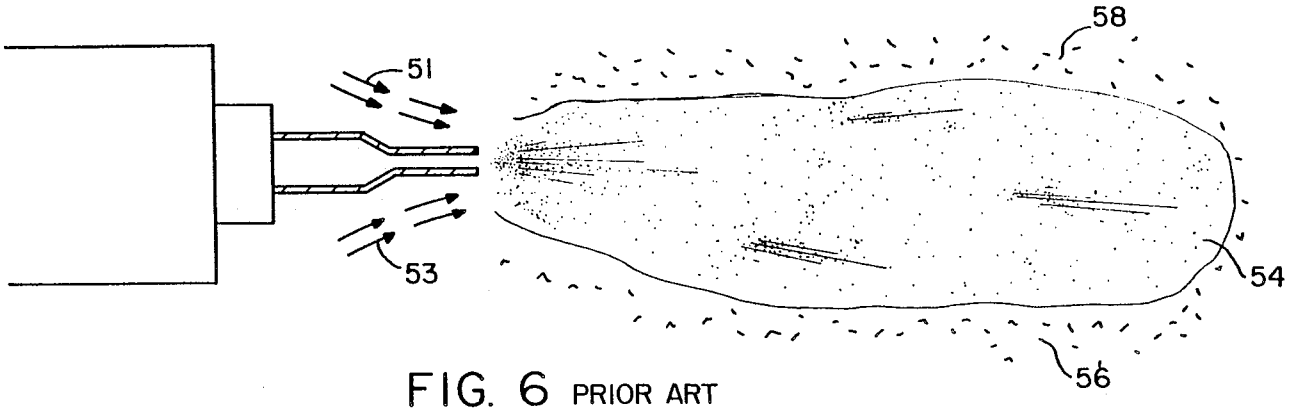
FIG. 6 PRIOR ART
FIG. 6 is a graphic representation of a blast pattern from a prior art ejection nozzle.
Figure 7:
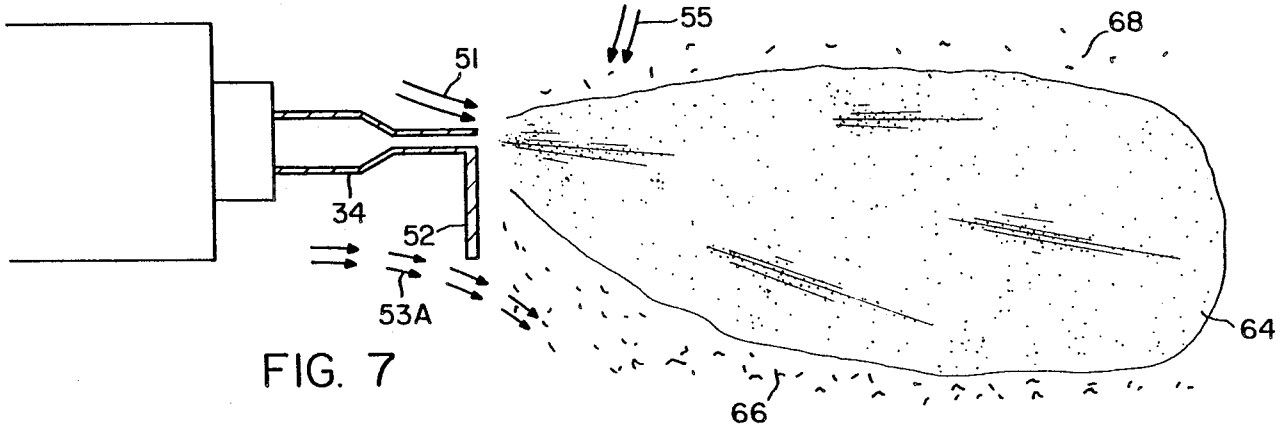
FIG. 7 is a graphic representation of a blast pattern from an ejector nozzle in accordance with a preferred embodiment of the present invention.

The only difference between the construction of nozzle 34 in FIG. 7 to the nozzle shown in FIG. 6 is that nozzle 34 includes depending tab 52. As a result, main air blast 64 in FIG. 7 is only slightly different from air blast 54 in FIG. 6. The main difference is that spurious particles 66 below air blast 64 are much more numerous than spurious particles 68 above air blast 64. This is because the pressure on the top side of the air blast is somewhat higher than the pressure on the low side, which causes the spurious particles that would otherwise scatter free about the main blast to be drawn back down into the blast.

To understand the operation of a blast of air from a nozzle, consider the prior art nozzle schematically represented in FIG. 6. Low pressure areas around the periphery of the nozzle and just in front thereof draw air currents 51 and 53 along the length of the nozzle from behind. The air from these regions is sometimes referred to as "make up" air. With a tab 52 (FIG. 7), the blast draws make up air 53A from a much lower point. This means that the low pressure region in front of the nozzle is both at a lower location, at a lower pressure relative to the surrounding ambient, relatively high pressure air 55, and encompasses a larger region. The pressure differential between high pressure air 55 and the low pressure region just below and in front of the nozzle pushes the blast down, as shown in FIG. 7 and decreases the number of dust particles that get free above the blast. There is still a low pressure region in front of the nozzle and just above it, as with the nozzle shown in FIG. 6, but it is not as large as that made by tab 52 below the nozzle.

It is apparent that a blocking structure or surface either attached to or located adjacent or close to the nozzle would have the same effect as tab 52 and can be employed instead of tab 52.

Further, although tab 52 is shown in nearly the vertical position in FIG. 7, assuming that the product flow past the nozzle is also vertical, tab 52 or other surface may be at a lesser angle than vertical, within a range of about ±45°.

In all events, it will be seen that an optical viewing window for the sensor or sensors located just above the nozzles of FIGS. 6 and 7 will be exposed to particle dust. However, over the same period of time, nozzle 34 will cause less dust contamination of the window than the nozzle of FIG. 6. Therefore, there will be less frequent need to shut down operation for cleaning the optical viewing window.

The conveyance of the products has been discussed with respect to the illustrated overall system, the conveyance being the result of gravity feed from hopper 16. It is apparent that the products could be conveyed on a belt or by some other means, the invention not being limited by the manner in which product flow is achieved. Moreover, the particular viewing arrangement of sensors and the electronic system for creating an actuation signal to the air blast device is not critical to the invention, although a particular mode of operation well-known in the art has been described for each. Thus, it will be understood that while a preferred embodiment of the invention has been shown and described, the invention is not limited thereto. Many modifications may be made and will become apparent to those skilled in the art.

What is claimed is:

1. A sorting machine for separating identifiable substandard products from a flow of fungible products traveling through the machine, comprising a channel through which the fungible products flow, viewing means having an optical sensor positioned for viewing said channel, said optical sensor including at least one sensor element, and a window in front of said sensor element for protecting said sensor element from dust contamination, electronic means connected to said sensor element for producing an actuation signal whenever a substandard product in the fungible products flow is detected by said sensor element, and an ejector located downstream from said viewing means actuated by the actuation signal to produce an air blast for ejecting each detected substandard product, said ejector including pressure differential means acting transverse to the direction of the air blast for drawing extraneous product dust away from said window to minimize dust build-up thereon that rapidly reduces the sensitivity of said sensor element.

2. A sorting machine in accordance with claim 1, wherein said ejector includes a nozzle directing the air blast across the flow of fungible products, and said pressure differential means is a surface blocking make up air close to the end of said nozzle, said surface being located on the side of said nozzle opposite said window.

3. A sorting machine in accordance with claim 2, wherein said surface is a tab connected to the end of said nozzle at an angle of approximately 90° to the primary direction of the air blast.

4. A sorting machine in accordance with claim 2, wherein said tab is at a right angle to the primary direction of the air blast.

5. A sorting machine in accordance with claim 2, wherein said nozzle includes an elongate opening transverse to the flow of fungible products.

6. A sorting machine in accordance with claim 1, wherein said flow of fungible products is a result of gravity action, said optical sensor includes a plurality of sensor elements circumscribing at least a substantial portion of said flow of fungible products, said window is at least partially ring like, and said ejector means is located in close proximity just below said window.

* * * * *